US007497756B2

(12) United States Patent
Wu

(10) Patent No.: US 7,497,756 B2
(45) Date of Patent: Mar. 3, 2009

(54) MINIATURE TOY VEHICLE SERVICEABLE AS ERASER AND PENCIL SHARPENER

(76) Inventor: Chieh-Yuan Wu, No. 69, Sec. 3, Datong Rd., Sijhih City, Taipei County 221 (TW)

( * ) Notice: Subject to any disclaimer, the term of this patent is extended or adjusted under 35 U.S.C. 154(b) by 432 days.

(21) Appl. No.: 11/296,499

(22) Filed: Dec. 8, 2005

(65) Prior Publication Data

US 2007/0130783 A1 Jun. 14, 2007

(51) Int. Cl.
*A63H 17/00* (2006.01)

(52) U.S. Cl. ..... 446/71; 446/237; 446/491; 30/451

(58) Field of Classification Search ..... None
See application file for complete search history.

(56) References Cited

U.S. PATENT DOCUMENTS 4,768,987 A * 9/1988 Usui et al. ..... 446/71

FOREIGN PATENT DOCUMENTS

FR 2485381 A * 12/1981
GB 2175856 A * 12/1986
JP 59138430 A * 8/1984
JP 01015085 A * 1/1989
JP 09173656 A * 7/1997
JP 2001070662 A * 3/2001

OTHER PUBLICATIONS

U.S. Toy Company 2003 Catalog, p. 92, Space shattle eraser.*
Hong Kong Toys Jan. 1, 1998) p. 21: toys indicated by arrows. 2) p. 1325: upper left: Future Vehicles Pencil Sharpeners.*

* cited by examiner

*Primary Examiner*—Ronald Laneau
*Assistant Examiner*—Tramar Harper
(74) *Attorney, Agent, or Firm*—Raymond Y. Chan; David and Raymond Patent Firm

(57) ABSTRACT

A miniature toy vehicle serviceable as an eraser and a pencil sharpener is primarily composed of a chassis and a housing combined thereto. A sharpener base for being screwed with a blade is provided at an appropriate position on the chassis, while a cone hole is provided at the side of the sharpener base for receiving a pencil to be sharpened. The front end and the rear end of the chassis are provided with respective wheel axles, the two ends of which are provided with tires, while a driving device is combined to the front or rear wheel axle, for moving on a plane. The housing is made of an eraser material, the side of which has a through hole corresponding to the shape of the cone hole at the sharpener base, thereby the housing can be combined to the chassis to form a toy vehicle.

4 Claims, 10 Drawing Sheets

MINIATURE TOY VEHICLE SERVICEABLE AS ERASER AND PENCIL SHARPENER

BACKGROUND OF THE INVENTION (a) Field of the Invention

The present invention relates to a miniature toy vehicle, particular to one that can also serve as an eraser and a pencil sharpener.

(b) Description of the Prior Art

During school days, erasers, pencils and pencil sharpeners are necessities to students, and are close to each other in relation. Although various kinds of erasers and pencil sharpeners appear in the market, as either of them performs single utility only, students always lose either one when they are in need of them. Thus, there exists a need for disclosing a novel product that combines a pencil sharpener and an eraser, and can be served as an ornament when it is not in use.

In addition, kids are fond of toys in their childhood, wherein miniature toy vehicles are particularly popular to kids. However, as kids used to lose interest in toy vehicles after a period of time, those toy vehicles are generally put in a container or disposed away, rendering waste of money and resource. As such, the inventor has positively researched to develop a toy vehicle design that has multi-purpose utilities, and can inspire kids to devote their attention to their homework while they can play the toy vehicle at another time.

In view of the above, the inventor has disclosed the miniature toy vehicle serviceable as an eraser and a pencil sharpener of the present invention.

SUMMARY OF THE INVENTION

The primary object of the invention is to provide a miniature toy vehicle, which not only can serve the purposes of appreciation and entertainment, but also have the utilities of an eraser and a pencil sharpener.

To obtain the above objects, the present invention is primarily composed of a chassis and a housing combined thereto. A sharpener base for being screwed with a blade is provided at an appropriate position on the chassis, while a cone hole is provided at the side of the sharpener base for receiving a pencil to be sharpened, thereby forming a pencil sharpener. The front end and the rear end of the chassis are provided with respective wheel axles, the two ends of which are provided with tires, while a driving device is combined to the front or rear wheel axle. By way of the rolling spring installed in the driving device, the winded spring can store a retrieval power to appropriately cooperate with a gear, thereby driving the toy vehicle to move on a plane. The housing is made of an eraser material, the side of which has a through hole corresponding to the shape of the cone hole at the sharpener base, thereby the housing can be combined to the chassis to form a toy vehicle. Accordingly, the miniature toy vehicle can also serve as an eraser and a pencil sharpener.

To completely appreciate these and other objects of the present invention as well as the invention itself, all of which will become apparent to those skilled in the art, the following detailed description of the invention and the claims should be read in conjunction with the accompanying drawings.

DETAILED DESCRIPTION OF THE PREFERRED EMBODIMENTS

Figure 1:
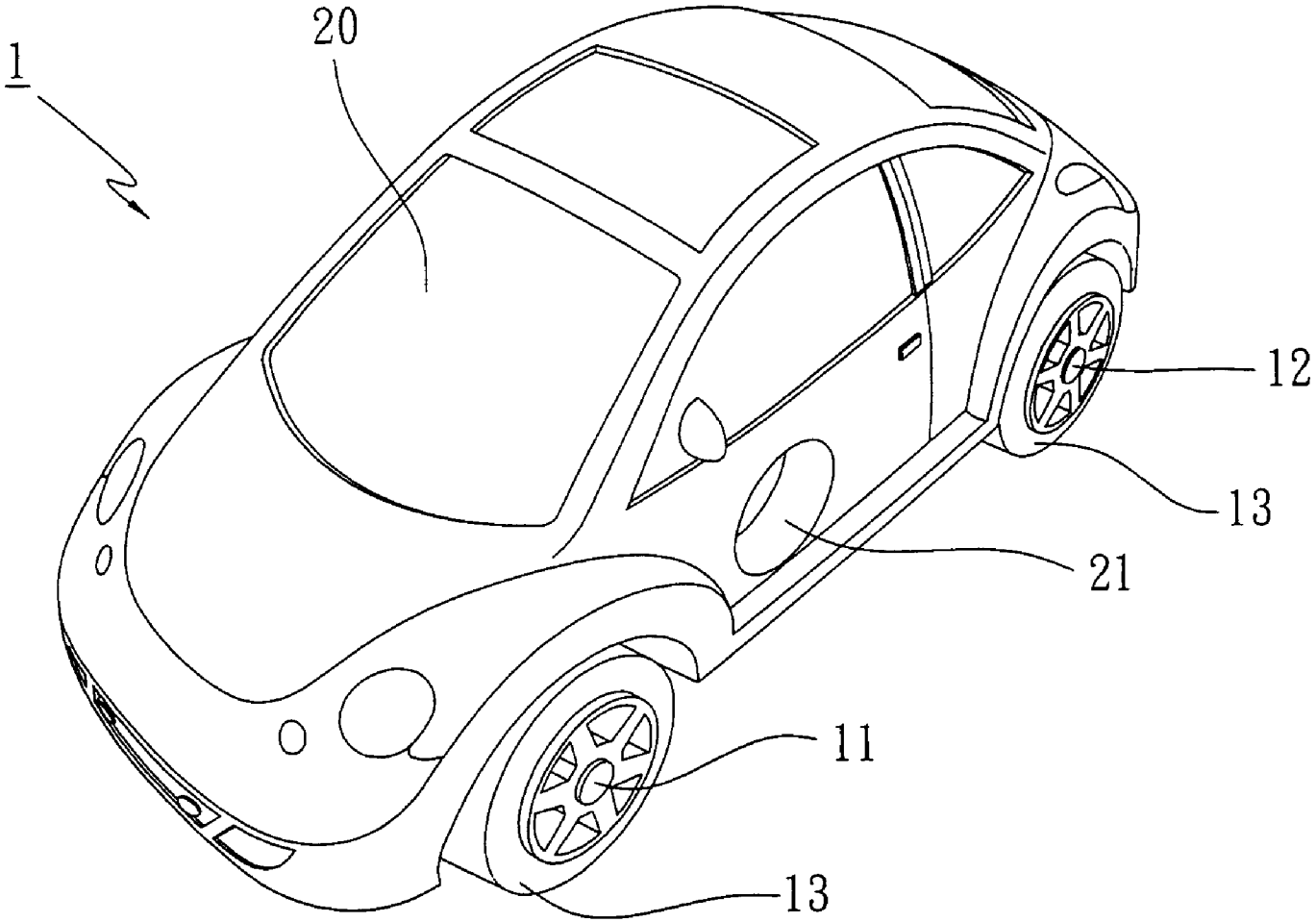
FIG. 1 is a perspective view of the present invention.
Figure 2:
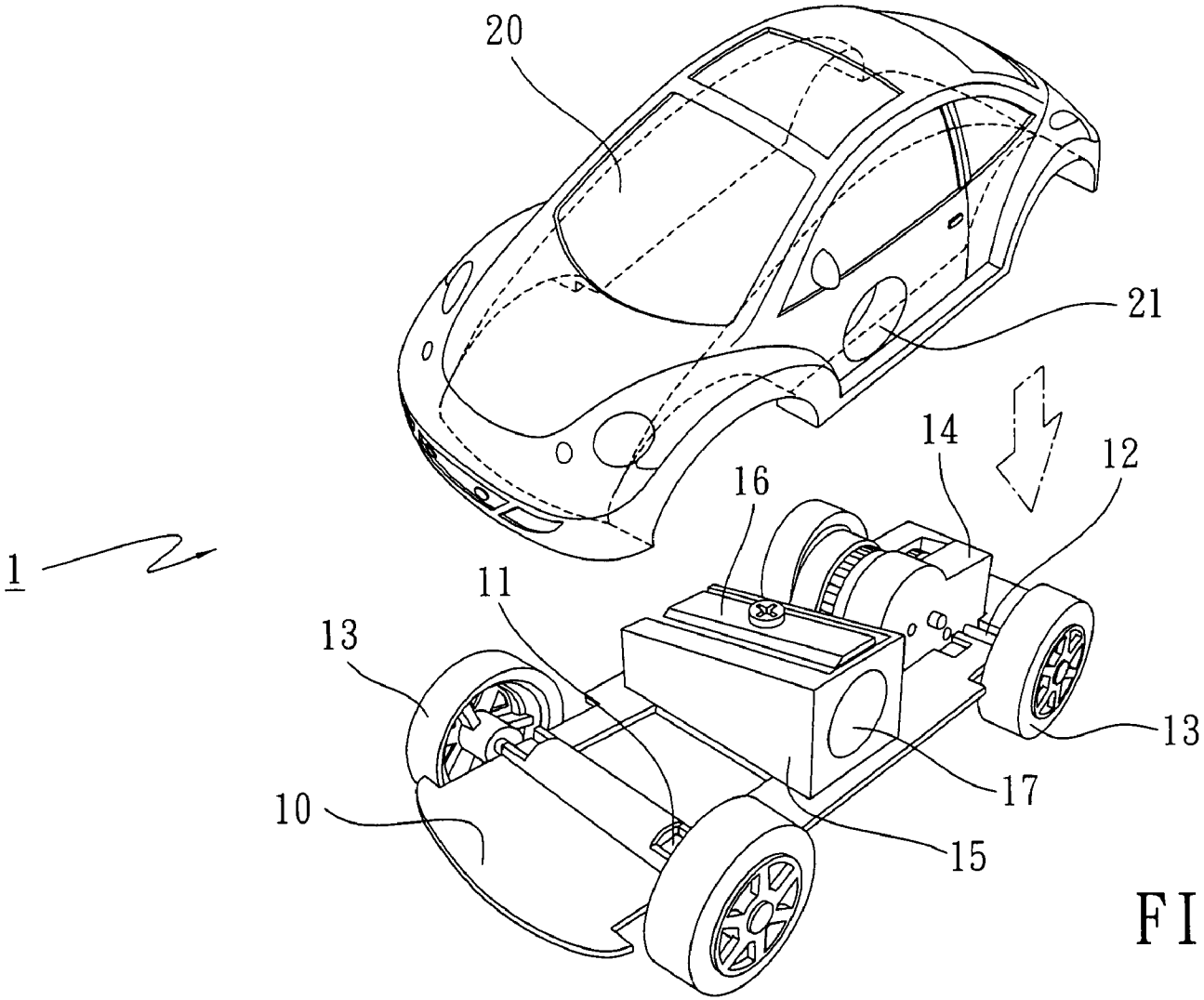
FIG. 2 is an exploded view of the invention.
Figure 3:
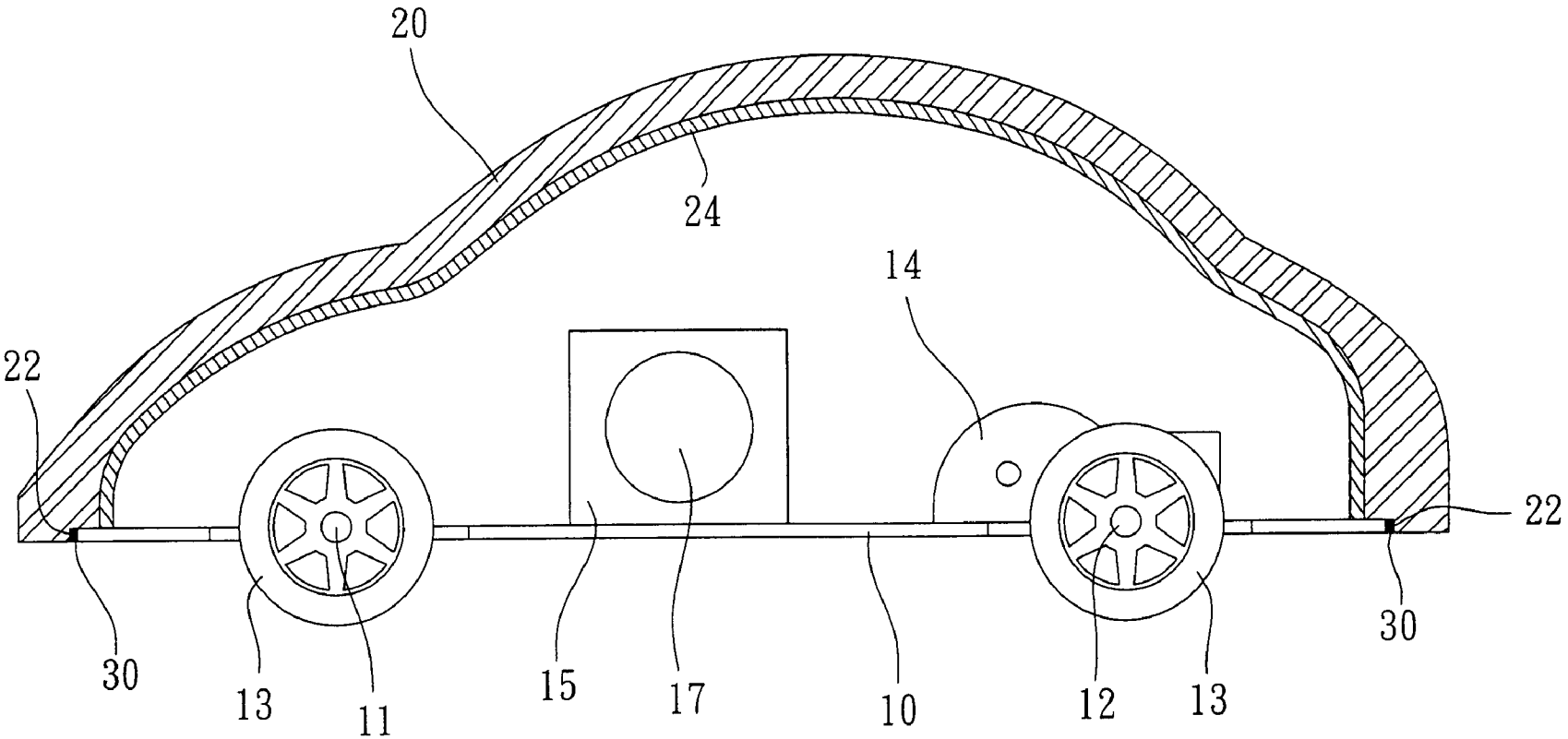
FIG. 3 is a cut-away view of the invention.

Referring to FIGS. 1 to 3, the invention is a miniature toy vehicle serviceable as an eraser and a pencil sharpener, which is composed of a chassis 10 and a housing 20 combined thereto.

The front end and the rear end of the chassis 10 are provided with respective wheel axles (11, 12), the two ends of which are provided with tires 13, while a driving device 14 is combined to the front or rear wheel axle (11, 12). By way of the rolling spring installed in the driving device 14, the winded spring can store a retrieval power to appropriately cooperate with a gear (not shown), thereby the power stored in the rolling spring can drive the toy vehicle to move on a plane after the toy vehicle 1 is pressed backwardly. Besides, a sharpener 15 screwed with a blade 16 is protrudedly provided at an appropriate position on the chassis 10. One side of the sharpener 15 has a cone hole for receiving a pencil 40 (as shown in FIG. 4) for sharpening the pencil tip.

The housing 20 is made of an eraser material according to a predetermined shape which integrally covers on a plastic housing 24. The side of the housing 20 has a through hole 21 corresponding to the shape of the cone hole 17 at the sharpener base 15; and a step 22 is around the periphery of the housing 20, thereby the housing 20 can be combined to the chassis 10 to form a toy vehicle 1 via adhesive 30.

Figure 4:
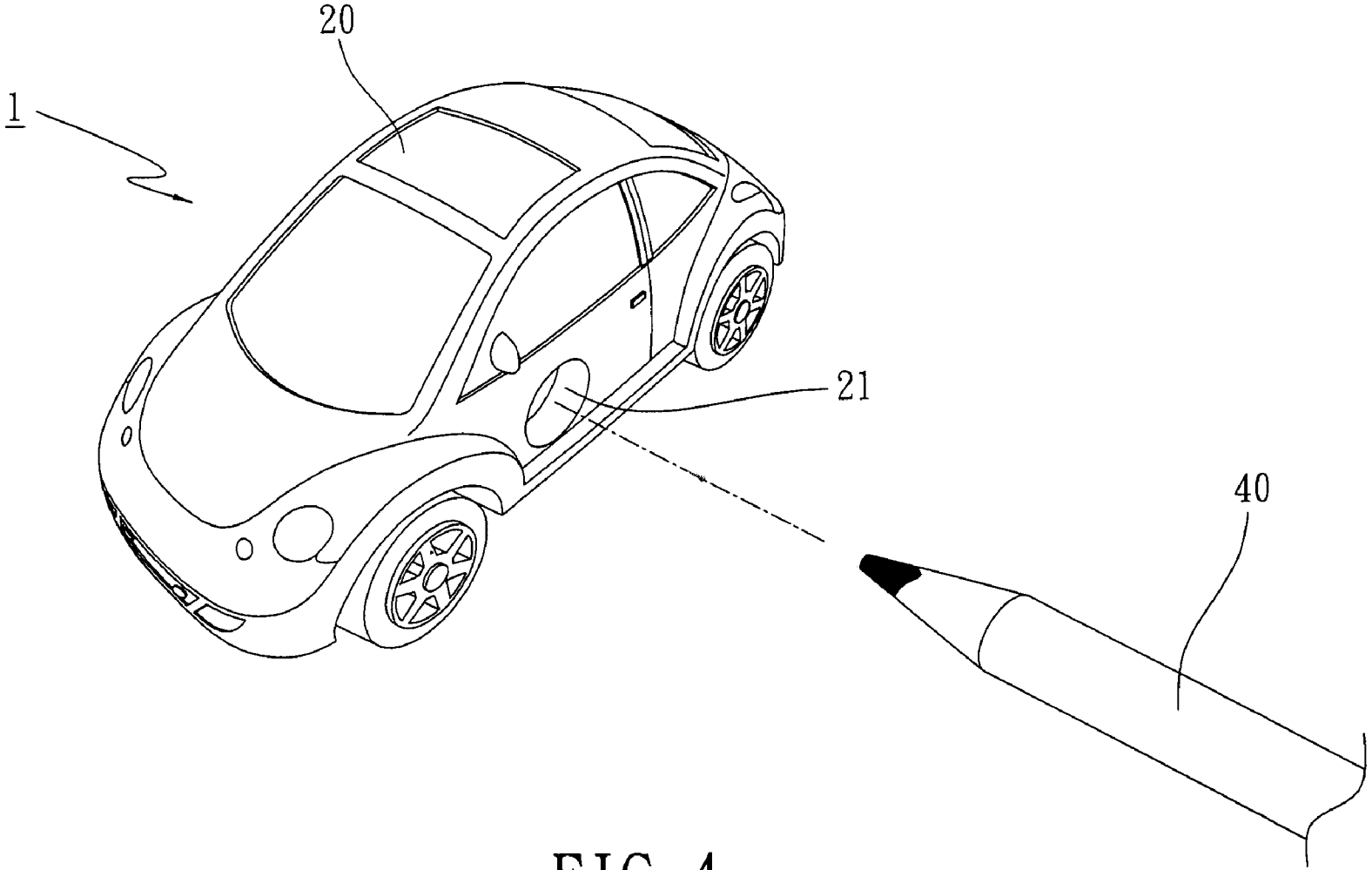
FIG. 4 shows application of the invention as a pencil sharpener.
Figure 5:
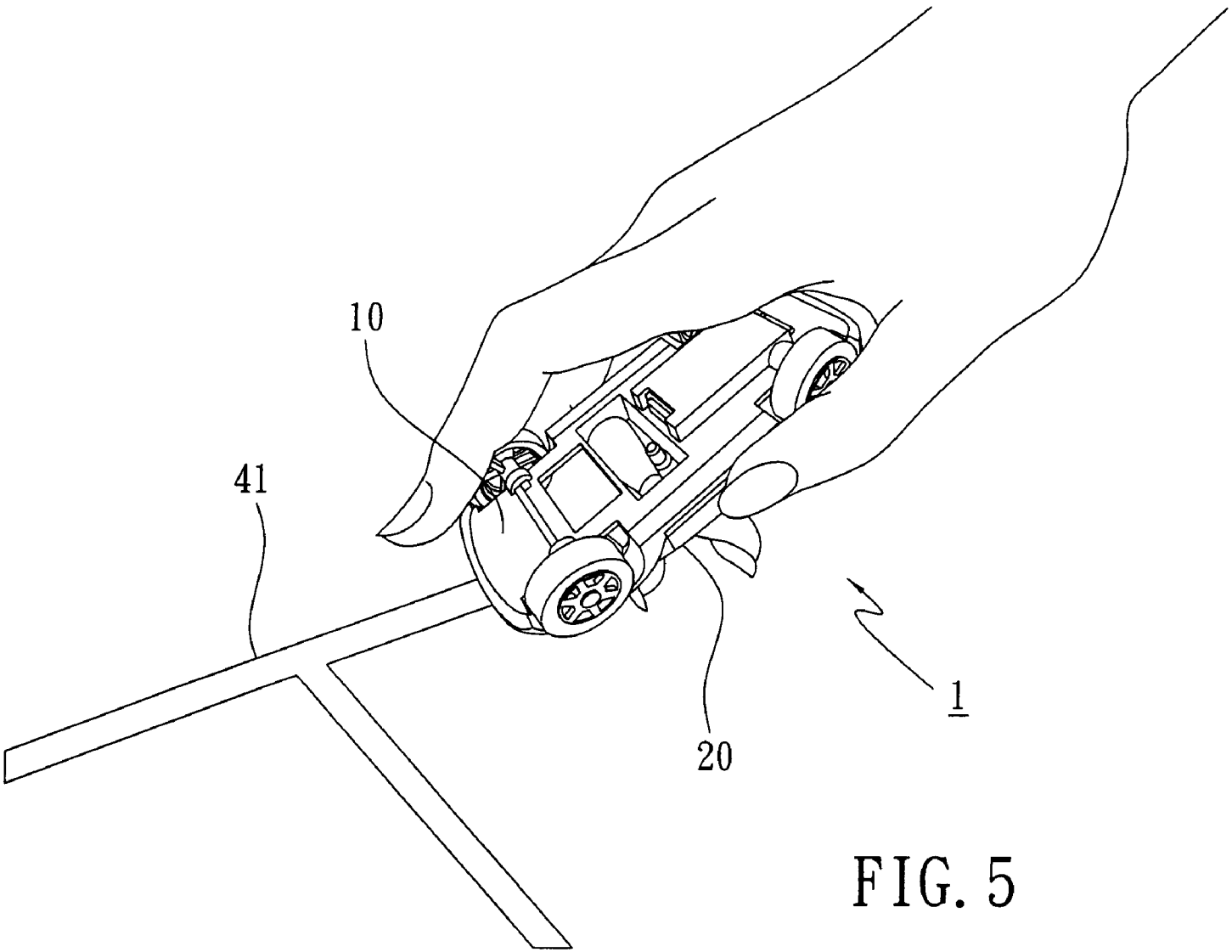
FIG. 5 shows application of the invention as an eraser.

As shown in FIGS. 4 and 5, the user can insert the pencil 40 to be sharpened from the through hole 21 at the side of the toy vehicle 1 and rotate the pencil 40. Accordingly, the toy vehicle 1 can served as a sharpener (as shown in FIG. 4). If the toy vehicle 1 is turned up side down to keep the housing 20 downwardly, the plastic material of the housing 20 can erase the line 41 made by the pencil 40, thereby serving as an eraser (as shown in FIG. 5).

Figure 6:
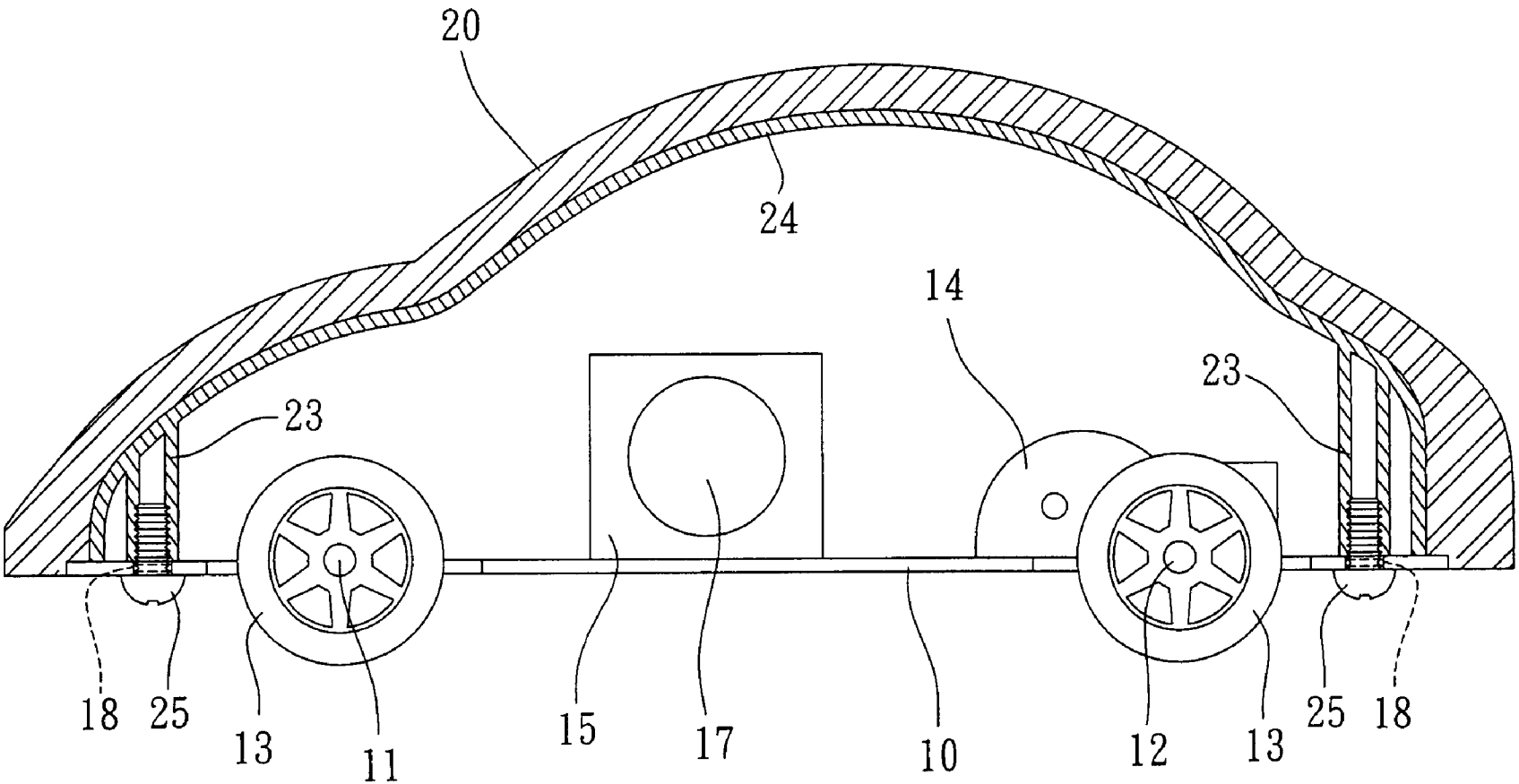
FIG. 6 is a cut-away view showing another assembly of the invention.

FIG. 6 shows another assembly of the invention, in which the chassis 10 has pluralities of apertures 18, while the inner plastic housing 24 of the housing 20 is downwardly provided with posts 23 corresponding to the apertures 18. By way of screws 25 going from outside into the posts 23 through to the apertures 18 on the chassis 10 for combination purposes.

Figure 7:
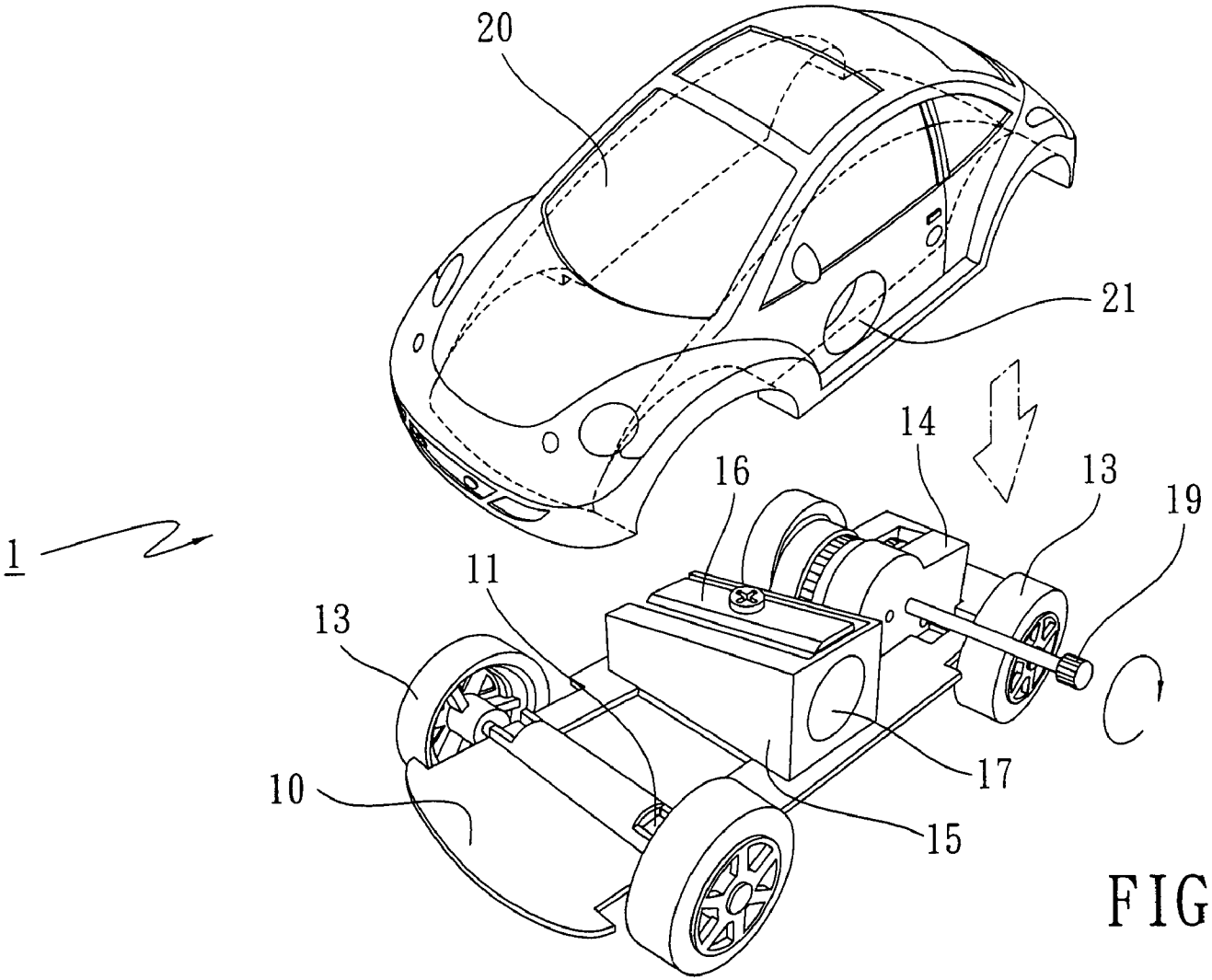
FIG. 7 is an exploded view showing combination of a winder in the invention.
Figure 8:
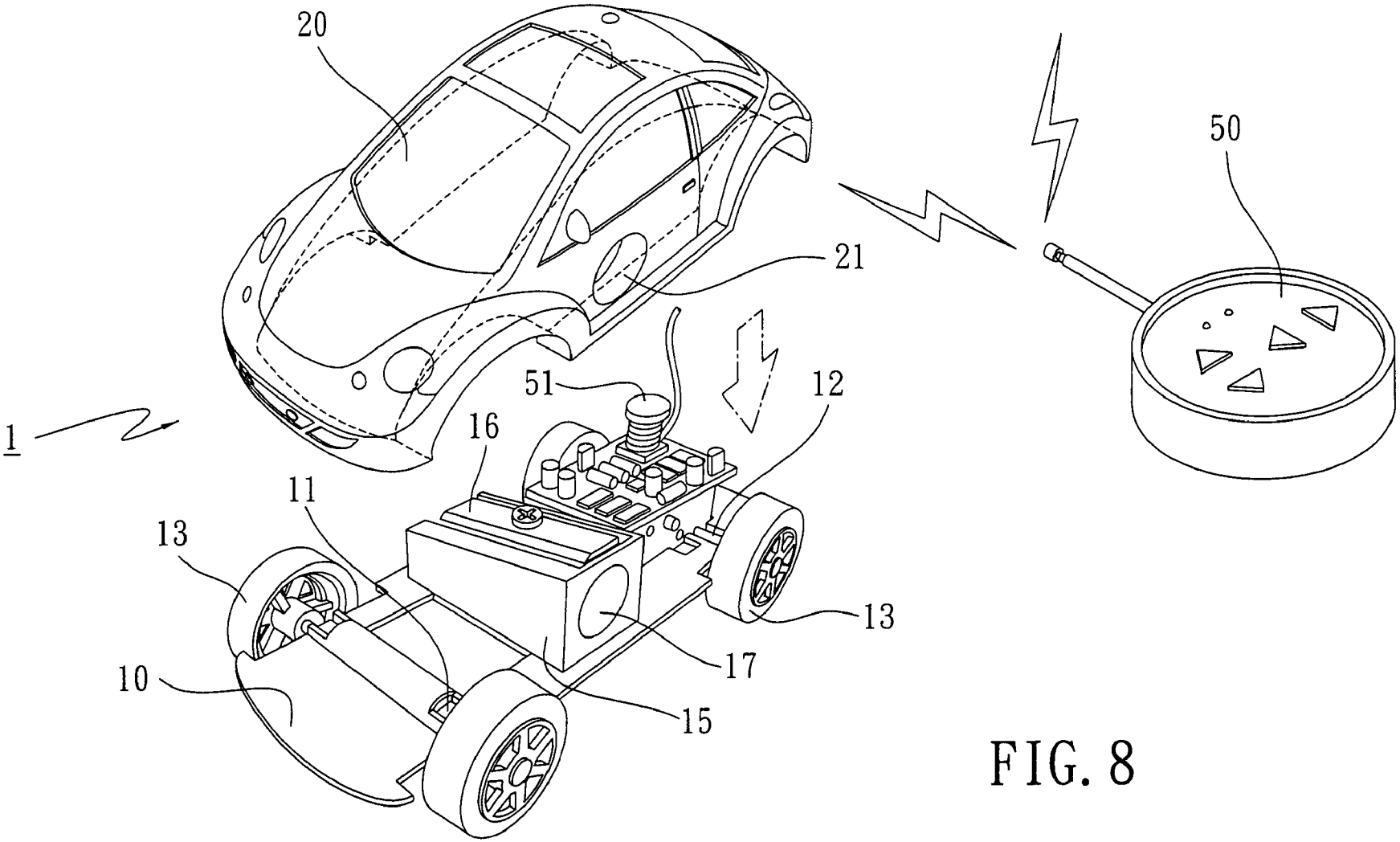
FIG. 8 is an exploded view showing combination of a remote controlling unit in the invention.

FIGS. 7 and 8 show another embodiment of the invention, in which the driving device 14 is internally provided with a spring (not shown) rolled up by a rolling spring for storing a retrieval power. By way of combining a winder 19 and rotating it to store a retrieval power in the rolling spring inside the driving device 14, the toy vehicle 1 can be driven to proceed (as shown in FIG. 7). Furthermore, the driving device 14 can be replaced by a electric motor which is connected with a receiver 51. By way of a wireless remote controller 50, the signal can be sent, thereby controlling the toy vehicle 1 to proceed (as shown in FIG. 8).

Figure 9:
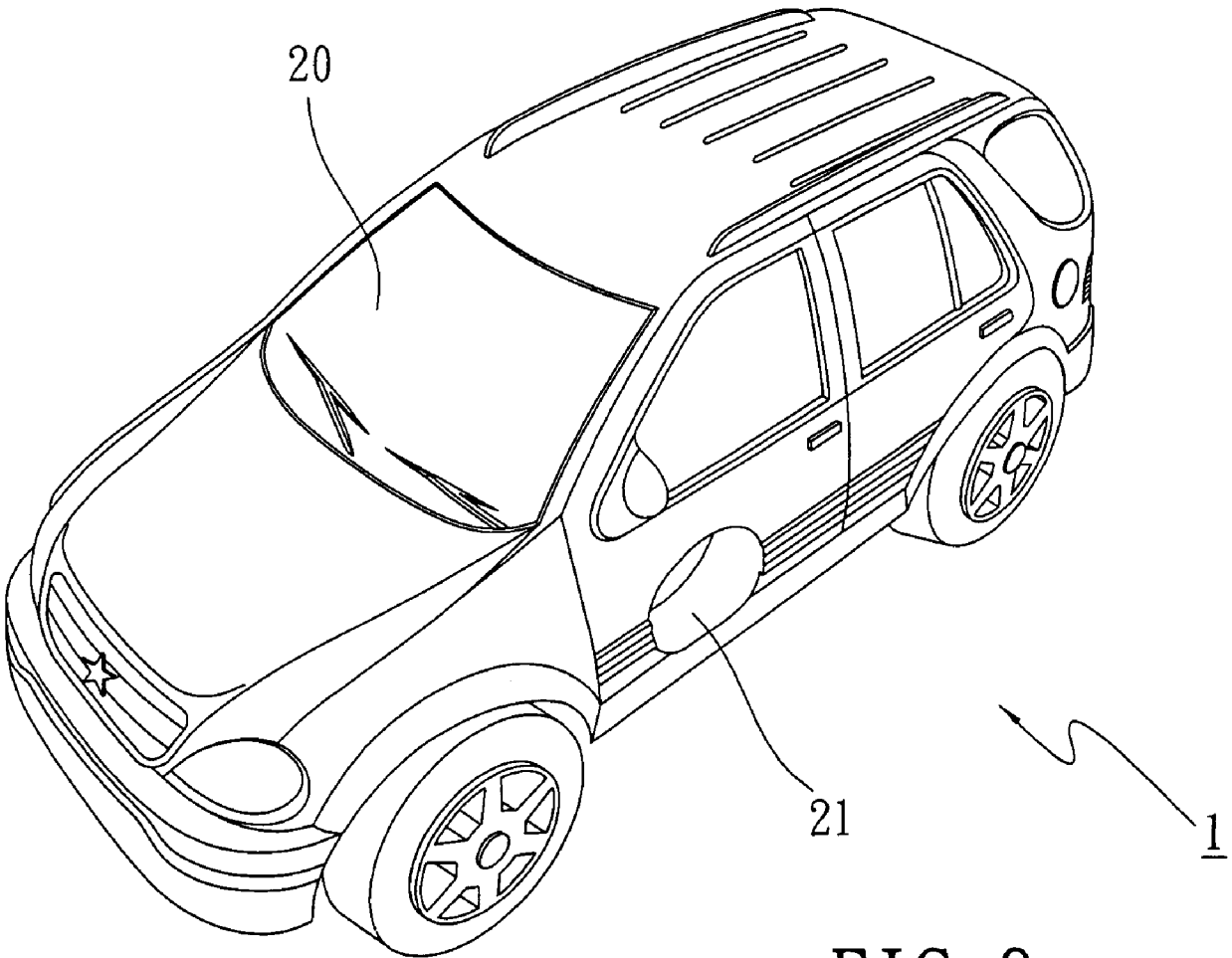
FIG. 9 is a perspective view of another embodiment of the invention.
Figure 10:
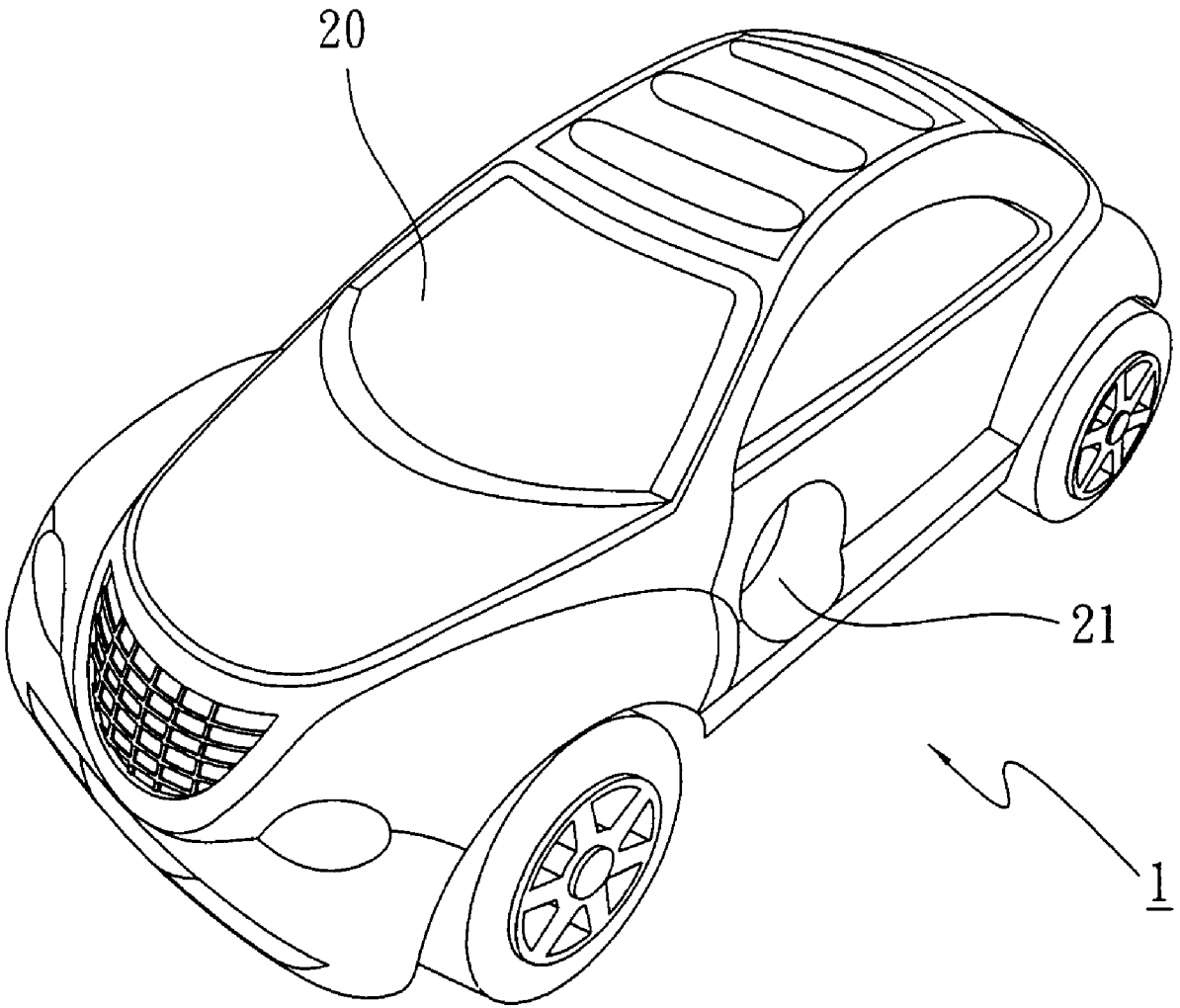
FIG. 10 is a perspective view of a further embodiment of the invention.

Referring to FIGS. 9 and 10, the housing can be made into various styles and combined with the chassis to become various kinds of vehicles. Accordingly, the consumer may have more choices to fit their fondness.

Concluded above, the miniature toy vehicle is simply constructed, and not only can provide the utilities of entertainment and appreciation, but also can be serviceable as an eraser and a pencil sharpener.

While certain novel features of this invention have been shown and described and are pointed out in the annexed Claims, it is not intended to be limited to the details above, since it will be understood that various omissions, modifications, substitutions and changes in the forms and details of the device illustrated and in its operation can be made by those skilled in the art without departing in any way from the spirit of the present invention.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A miniature toy vehicle serviceable as an eraser and a pencil sharpener, comprising:

a chassis having a front end and a rear end provided with front and rear wheel axles respectively, two ends of each of the wheel axles provided with two tires respectively for moving on a plane;

a sharpener base having a blade mounted on top thereof is protrudedly provided on top of the chassis and a cone hole provided at a side of the chassis for receiving a pencil for sharpening a pencil tip thereof;

a housing comprising an inner housing made of rigid material combined to the chassis defining a space therebetween and an outer housing made of eraser material integrally covering the inner housing, wherein a side of the housing has a through hole positioned and shaped according to the cone hole of the sharpener base in such a manner that the pencil to be sharpened is able to insert into the cone hole through the through hole at the side of the housing for sharpening the tip of the pencil, wherein the outer housing serving as an eraser to erase pencil markings; and a driving device provided on the chassis driving one of the front and rear wheel axles and the tires thereof to move on the plane, wherein the driving device is combined with a receiver, and controlled by a wireless remote controller.

2. The miniature toy vehicle according to claim 1, wherein the driving device is combined with a winder for winding a rolling spring therein to store retrieval power for driving the toy vehicle to proceed.

3. The miniature toy vehicle according to claim 1, wherein the rim of the housing is provided with steps which are bonded with the chassis via an adhesive.

4. The miniature toy vehicle according to claim 1, wherein the chassis is provided with pluralities of apertures, while the interior of the housing is provided with posts corresponding to said apertures, such that screws are screwed from the exterior of the toy vehicle through the apertures of the chassis to the posts for fastening purposes.

* * * * *